US008758124B2

(12) United States Patent
Cowan et al.

(10) Patent No.: US 8,758,124 B2
(45) Date of Patent: Jun. 24, 2014

(54) APPARATUS AND METHOD FOR DETERMINING THE AWARD OF A PRIZE

(75) Inventors: Stephen Cowan, Taren Point (AU); Dean Wright, Taren Point (AU)

(73) Assignee: Paltronics Australasia Pty Limited, Taren Point, NSW (AU)

( * ) Notice: Subject to any disclaimer, the term of this patent is extended or adjusted under 35 U.S.C. 154(b) by 502 days.

(21) Appl. No.: 12/670,422

(22) PCT Filed: Jul. 24, 2008

(86) PCT No.: PCT/AU2008/001074
§ 371 (c)(1),
(2), (4) Date: Jan. 25, 2010

(87) PCT Pub. No.: WO2009/012529
PCT Pub. Date: Jan. 29, 2009

(65) Prior Publication Data

US 2010/0227676 A1 Sep. 9, 2010

(30) Foreign Application Priority Data

Jul. 25, 2007 (AU) ..... 2007904148

(51) Int. Cl.
*A63F 9/24* (2006.01)

(52) U.S. Cl.
USPC ..... 463/26; 463/27

(58) Field of Classification Search
USPC ..... 463/40, 42, 43, 25–27
See application file for complete search history.

(56) References Cited

U.S. PATENT DOCUMENTS

| | | | | |
|---|---|---|---|---|
| 4,101,129 | A | 7/1978 | Cox | |
| 5,280,909 | A | 1/1994 | Tracy | |
| 5,344,144 | A * | 9/1994 | Canon | 463/27 |
| 5,855,515 | A * | 1/1999 | Pease et al. | 463/27 |
| 5,885,158 | A * | 3/1999 | Torango et al. | 463/27 |
| 5,941,773 | A * | 8/1999 | Harlick | 463/26 |
| 6,012,982 | A | 1/2000 | Piechowiak et al. | |
| 6,110,043 | A | 8/2000 | Olsen | |
| 6,146,273 | A * | 11/2000 | Olsen | 463/27 |
| 6,217,448 | B1 * | 4/2001 | Olsen | 463/25 |

(Continued)

FOREIGN PATENT DOCUMENTS

| | | |
|---|---|---|
| CA | 2544446 A1 | 8/1995 |
| EP | 1513118 A2 | 3/2005 |

(Continued)

OTHER PUBLICATIONS

English Language Abstract for Japanese Patent Application 11-206982.*

*Primary Examiner* — Dmitry Suhol
*Assistant Examiner* — Jason Skaarup
(74) *Attorney, Agent, or Firm* — Brooks Kushman P.C.

(57) ABSTRACT

Apparatus (1) is disclosed for determining the award of a prize. The apparatus includes memory (2) for storing prize data indicative of a prize value for the prize. An input device (4) is responsive to input signals from a respective plurality of gaming terminals (6) for providing an increment signal. An increment device (8) is responsive to the increment signal for incrementing an accumulating value. A comparator (15) is responsive to the prize data and the accumulating value for determining if the prize is to be awarded and, if not, generating a continue signal. A processor (15) is responsive to the continue signal for refreshing the prize data.

13 Claims, 4 Drawing Sheets

(56) References Cited

U.S. PATENT DOCUMENTS

| | | | | |
|---|---|---|---|---|
| 6,224,482 | B1 * | 5/2001 | Bennett | 463/20 |
| 6,241,608 | B1 * | 6/2001 | Torango | 463/27 |
| 6,358,149 | B1 | 3/2002 | Schneider et al. | |
| 6,565,434 | B1 * | 5/2003 | Acres | 463/25 |
| 6,592,458 | B1 * | 7/2003 | Ho | 463/17 |
| 7,056,215 | B1 * | 6/2006 | Olive | 463/27 |
| 7,255,644 | B2 * | 8/2007 | Duhamel | 463/25 |
| 7,568,973 | B2 * | 8/2009 | Iddings et al. | 463/25 |
| 7,597,621 | B2 * | 10/2009 | Baerlocher | 463/28 |
| 7,841,939 | B2 * | 11/2010 | Baerlocher et al. | 463/25 |
| 8,128,491 | B2 * | 3/2012 | Vasquez et al. | 463/27 |
| 2003/0148808 | A1 | 8/2003 | Price | |
| 2005/0054435 | A1 | 3/2005 | Rodgers et al. | |
| 2005/0239542 | A1 * | 10/2005 | Olsen | 463/27 |
| 2005/0261050 | A1 | 11/2005 | Waters | |
| 2007/0149267 | A1 | 6/2007 | Ross et al. | |
| 2007/0191088 | A1 * | 8/2007 | Breckner et al. | 463/20 |
| 2007/0218982 | A1 * | 9/2007 | Baerlocher | 463/27 |

FOREIGN PATENT DOCUMENTS

| | | | | | |
|---|---|---|---|---|---|
| GB | 2334897 | A | | 9/1999 | |
| JP | 11206982 | A | * | 8/1999 | A63F 7/02 |
| WO | 2005008514 | A1 | | 1/2005 | |
| WO | 2005107912 | A1 | | 11/2005 | |
| WO | 2007045020 | A1 | | 4/2007 | |

* cited by examiner

APPARATUS AND METHOD FOR DETERMINING THE AWARD OF A PRIZE

FIELD OF INVENTION

The present invention relates to an apparatus and method for determining the award of a prize.

The invention has been developed primarily for use with a plurality of interlinked gaming machines in a gaming establishment and will be described hereinafter with reference to this application. However, the invention is not limited to that particular field of use and is also suitable for use with online gaming, gaming machines that are distributed over a plurality of gaming establishments, lotto, pools, lotteries, art unions, bingo, raffles and other games involving one or more wagers being placed upon an outcome having a finite probability of occurring.

BACKGROUND

It is known to "link" gaming machines to provide a number of additional functionalities. This includes the ability to control the awarding of a prize, as the pool of available funds is greater and the amount of funds available is known rather than having to be estimated. Another functionality of interlinked gaming machines is that secondary gaming is possible. For example, for a given group of interlinked gaming machines, a central display provides the gamers with a visual indication of an accumulating value that is being incrementally increased as the gamers operate the interlinked gaming machines. It is known by the gamers that a prize will be awarded when the accumulating value has incremented to a randomly selected prize value that is unknown to the gamers and which is less than a predefined value. Typically, the predefined value will also be visually indicated to the gamers by the display. At the time a prize is awarded the prize value is equal to or very similar to the accumulating value that is displayed to the gamers.

It is also known to provide a number of jackpot "prize levels", in that a plurality of accumulating values are simultaneously incrementing toward respective randomly selected prize values to provide a corresponding number of prizes available to be awarded to the gamers of the machine participating in the secondary game. Typically each level is defined by a range from which the respective prize value is randomly chosen, and the ranges of the levels can but often do not overlap. As the gaming machines are operated to allow the gamers to play the respective primary games a contribution of each wager made in the primary game is contributed to the secondary game. The contributions are provided by the individual gaming machines to a jackpot controller as part of respective input signals. The jackpot controller is responsive to the input signals for providing an increment signal for each prize level which, in turn, increments the respective accumulating values for those levels toward the respective prize value for those levels. Once a given accumulating value reaches the prize value for the given level, the prize is awarded by transferring funds corresponding to the prize value for that prize to the relevant gaming machine. Following the award of a prize for a level, a new prize value is selected for that level and the increments of the accumulating values continue.

The use of such functionality is intended to provide additional impetus to the gamers to play the machines and thereby win a prize in the secondary game in addition to any prize available to be awarded by the respective machine in the primary game. However, with the increasing sophistication of the gamers and their approach to gaming, the interest in the secondary game has diminished.

As the size and complexity of secondary games such as jackpot systems has increased there has been a proliferation of the number of prizes to be awarded. Each prize has a prize value that is stored in memory on the jackpot system and is open to abuse by less scrupulous venue operators or employees of that operator. For example, an operator may be tempted to access one or more of the prize values to determine when to focus his or her own efforts at winning one of the prizes available. This temptation is exacerbated for the larger jackpot prize values, and can present a significant security issue for larger venues where there is a need to have many personnel able to access the prize values to ensure continuous and reliable operation of the IT systems involved in implementing the secondary game.

The discussion of the prior art within this specification is to assist the addressee understand the invention and is not an admission of the extent of the common general knowledge in the field of the invention and is included without prejudice.

SUMMARY OF THE INVENTION

It is an object of the present invention to overcome, or at least substantially ameliorate, one or more of the disadvantages of the prior art or at least to provide a useful alternative.

According to a first aspect of the invention there is provided an apparatus for determining the award of a prize, the apparatus including:

memory for storing prize data indicative of a prize value for the prize;

an input device being responsive to input signals from a respective plurality of gaming terminals for providing an increment signal;

an increment device that is responsive to the increment signal for incrementing an accumulating value;

a comparator being responsive to the prize data and the accumulating value for determining if the prize is to be awarded and, if not, generating a continue signal; and a processor that is responsive to the continue signal for refreshing the prize data.

In an embodiment, refreshing the prize data includes changing the prize data.

In an embodiment, the changing of the prize data changes the prize value of the prize.

In an embodiment, the memory stores range data that is indicative of an upper prize value and a lower prize value that collectively define a range that contains the prize value.

In an embodiment, the changing of the prize value results in the prize value falling between the accumulating value and one of the upper and lower prize values.

In an embodiment, the increment device increments the accumulating value toward the upper prize value and the changing of the prize value results in the prize value falling between the accumulating value and the upper prize value.

In an embodiment, the increment device increments the accumulating value toward the lower prize value and the changing of the prize value results in the prize value falling between the accumulating value and the lower prize value.

In an embodiment, the input device is responsive to the input signals during a first period and comparator is responsive to the accumulating value and the prize value for determining if the prize is to be awarded for the first period and, if not, generating the continue signal.

In an embodiment, the input device is responsive to the input signals during a second period subsequent to the first period and the processor is responsive to the continue signal for refreshing the prize data for the second period.

In an embodiment, the second period is immediately subsequent to the first period.

In an embodiment, at least one of the first and second periods are a polling period.

In an embodiment, the first and second periods are respective polling periods.

In an embodiment, the first and second periods are separated by at least one intervening polling period.

In an embodiment, the first and second periods are separated by a randomly determined number of intervening polling periods.

According to a second aspect of the invention there is provided an apparatus for determining the award of a prize having a prize value, the apparatus including:

memory for storing prize data indicative of the prize value;

an input device being responsive to input signals from a respective plurality of gaming terminals for providing an increment signal;

an increment device for that is responsive to the increment signal for incrementing an accumulating value;

a comparator being responsive to the prize value and the accumulating value for determining if the prize is to be awarded and, if not, generating a continue signal; and a processor that is responsive to the continue signal for selecting a further prize having a further prize value and updating the prize data to be indicative of the further prize value.

According to a third aspect of the invention there is provided a method for determining the award of a prize, the method including:

storing prize data indicative of a prize value for the prize;

being responsive to input signals from a respective plurality of gaming terminals for providing an increment signal;

being responsive to the increment signal for incrementing an accumulating value;

being responsive to the prize data and the accumulating value for determining if the prize is to be awarded and, if not, generating a continue signal; and being responsive to the continue signal for refreshing the prize data.

According to a fourth aspect of the invention there is provided a method for determining the award of a prize having a prize value, the method including:

storing prize data indicative of the prize value;

being responsive to input signals from a respective plurality of gaming terminals for providing an increment signal;

being responsive to the increment signal for incrementing an accumulating value;

being responsive to the prize value and the accumulating value for determining if the prize is to be awarded and, if not, generating a continue signal; and being responsive to the continue signal for selecting a further prize having a further prize value and updating the prize data to be indicative of the further prize value.

According to a fifth aspect of the invention there is provided an apparatus for storing a prize value for a prize, the apparatus including:

a first interface for receiving prize data indicative of the prize value;

memory for storing the prize data;

a second interface for receiving a continue signal indicative of the prize not being awarded; and a processor that is responsive to the continue signal for refreshing the prize data.

In an embodiment, refreshing the prize data includes changing the prize data. Preferably, changing of the prize data changes the prize value of the prize. More preferably, the memory stores range data that is indicative of an upper prize value and a lower prize value that collectively define a range that contains the prize value. Preferably also, the changing of the prize value results in the prize value falling between the accumulating value and one of the upper and lower prize values.

In an embodiment, the continue signal is generated in respect of a first period and the processor refreshes the prize data for a second period subsequent to the first period. Preferably, the second period is immediately subsequent to the first period. More preferably, at least one of the first and second periods are a polling period. Preferably also, the first and second periods are respective polling periods.

In an embodiment, the first and second periods are separated by at least one intervening polling period. In other embodiments the first and second periods are separated by a randomly determined number of intervening polling periods.

According to a sixth aspect of the invention there is provided a method for storing a prize value for a prize, the method including the steps of:

receiving prize data indicative of the prize value;

storing the prize data;

receiving a continue signal indicative of the prize not being awarded; and being responsive to the continue signal for refreshing the prize data.

BRIEF DESCRIPTION OF THE DRAWINGS

A preferred embodiment of the invention will now be described, by way of example only, with reference to the accompanying drawings, in which.

DETAILED DESCRIPTION OF THE PREFERRED EMBODIMENTS

At least some of the embodiments of the invention make use of certain elements of hardware and software similar to that disclosed in PCT application PCT/AU2004/000964 the disclosure of which is incorporated herein by way of cross-reference.

Figure 1:
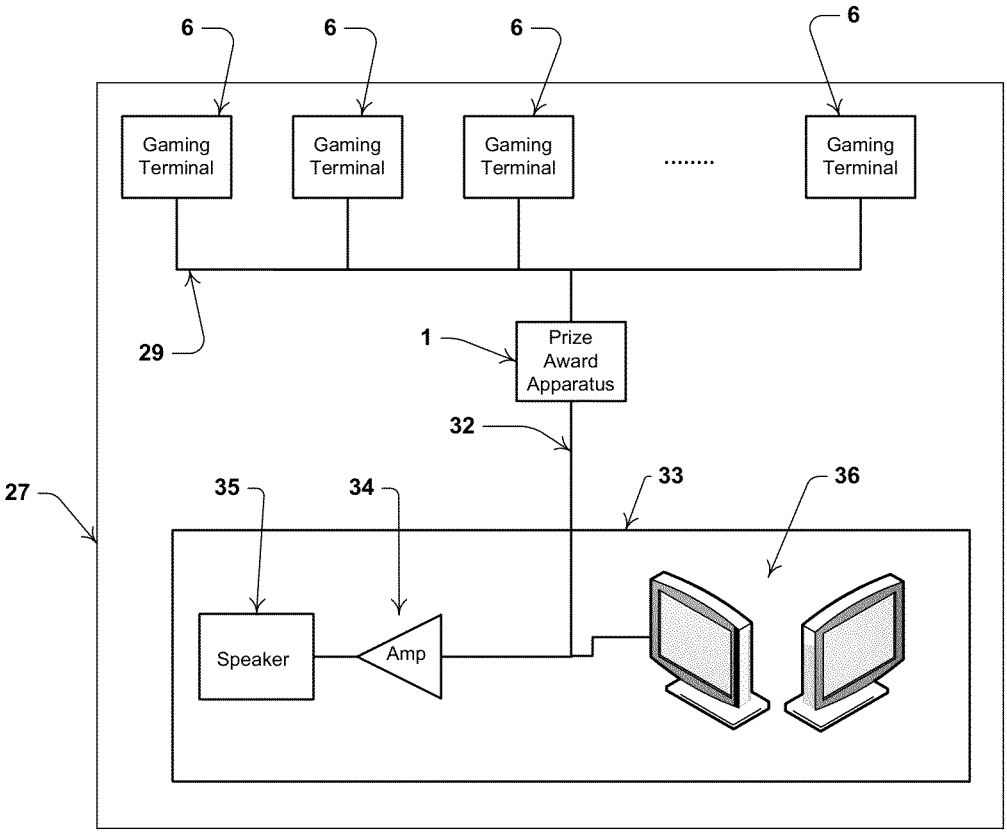
FIG. 1 is a schematic view of a gaming network including an apparatus according to the invention.
Figure 2:
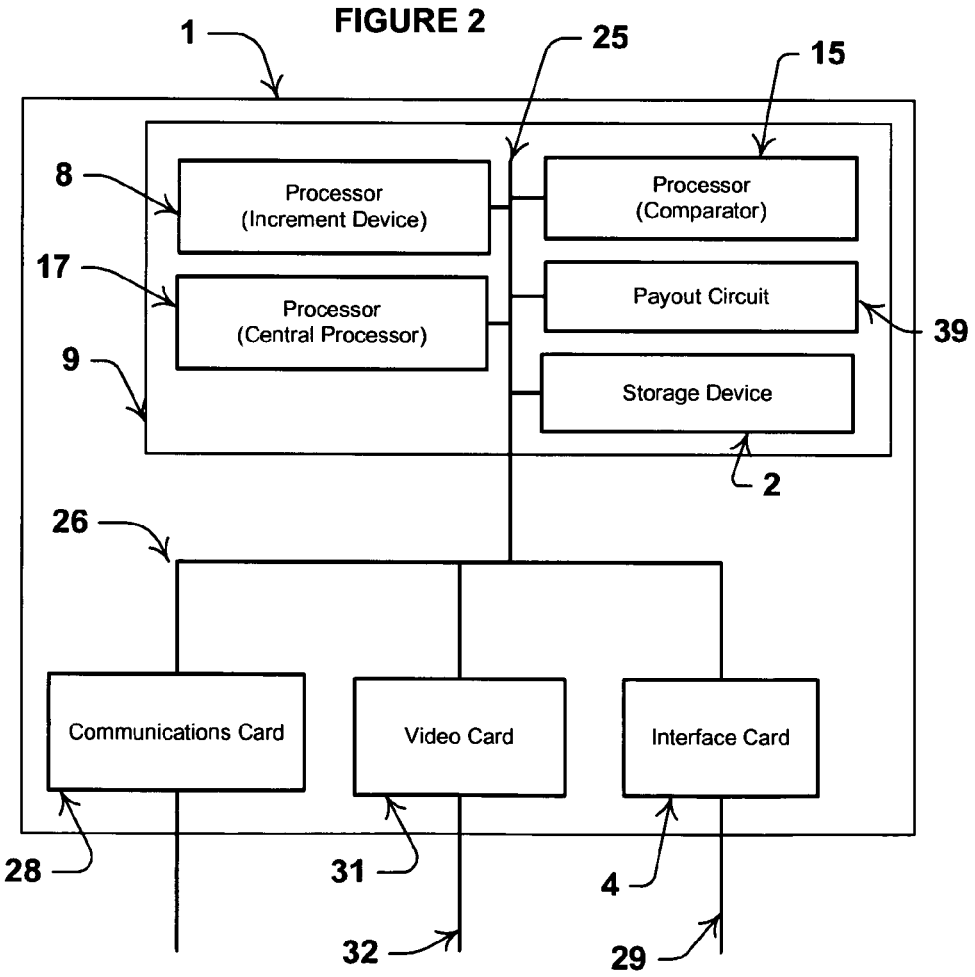
FIG. 2 is a schematic view in more detail of the apparatus shown in FIG. 1.
Figure 5:
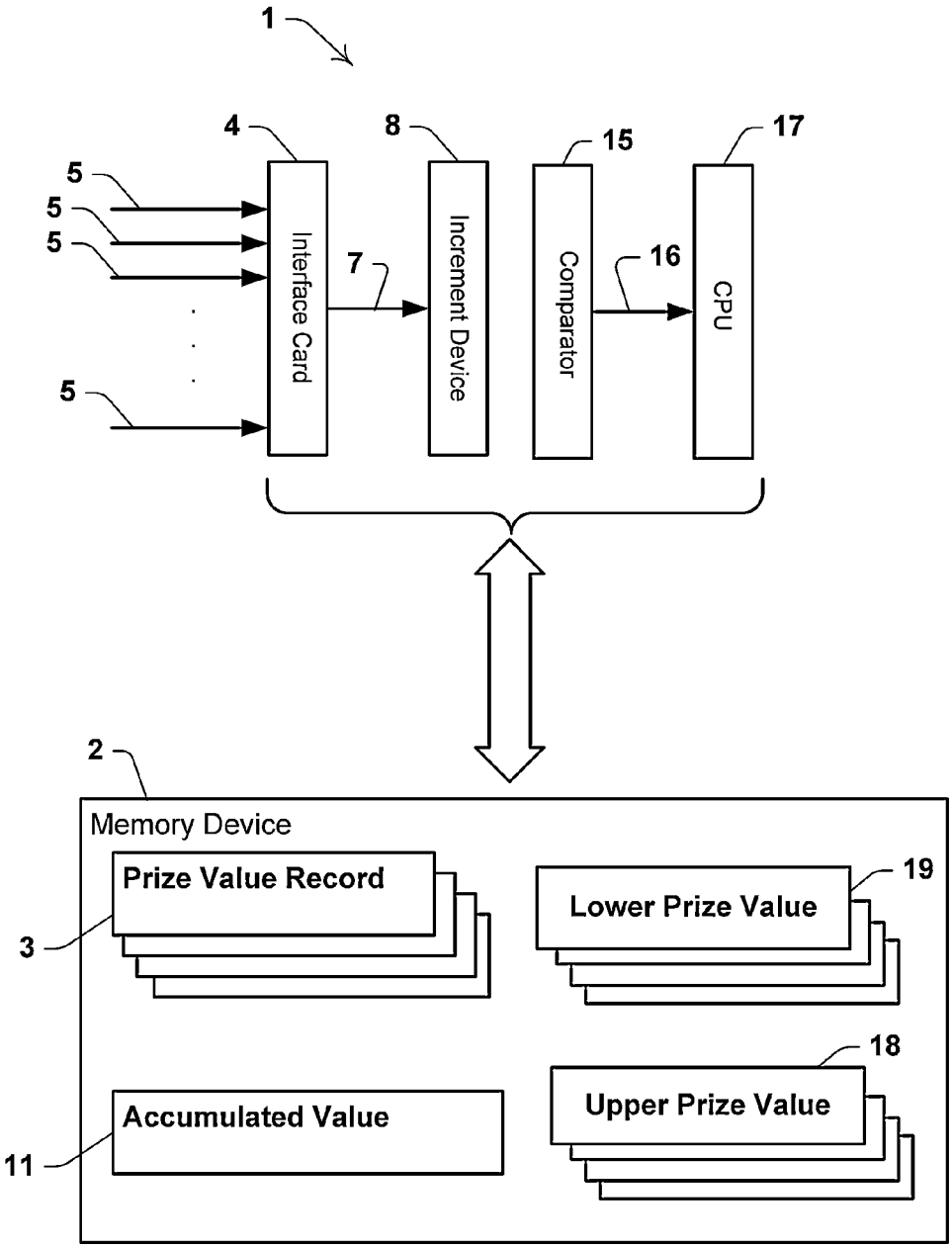
FIG. 5 is a schematic representation of some of the data flows occurring during the operation of the apparatus of FIG. 2.

Referring to FIG. 2 and FIG. 5 there is illustrated an apparatus 1 for determining the award of a prize. The apparatus includes memory in the form of a storage device 2 for storing prize data in the form of records 3 that are indicative of a prize value for the prize. An input device, in the form of a serial electronic interface (SEI) card 4, is responsive to input signals 5 from a respective plurality of gaming terminals 6—where terminals 6 are shown in FIG. 1—for providing an increment signal 7. As best shown in FIG. 5, an increment device, in the form of a local processor 8, is mounted to a motherboard 9 and is responsive to increment signal 7 for incrementing an accumulating value 11 that is also stored in device 2. A comparator, in the form of a further local processor 15, is also mounted to motherboard 9. Processor 15 is responsive to records 3 and value 11 for determining if the prize is to be awarded and, if not, generating a continue signal 16. A processor, in the form of a central processor 17 that is also mounted to motherboard 9, is responsive to signal 16 for refreshing records 3 to change the records and thereby change the prize value of the prize.

Storage device 2 also stores range data in the form of records 18 and 19 that are indicative of an upper prize value and a lower prize value respectively. The upper and lower values collectively define a range that contains the prize value. In this embodiment, processor 8 increments value 11 toward the upper prize value and the changing of the prize value results in the prize value falling between value 11 and the upper prize value. In other embodiments processor 8 increments value 11 toward the lower prize value and the changing of the prize value results in the prize value falling between value 11 and the lower prize value. In other embodiments, apparatus 1 determines sequentially the award of a plurality of prizes and processor 8 for some of those prizes increments value 11 toward the upper prize value and for the remainder of the prizes increments value 11 toward the lower prize value. In turn, the changing of the prize value results in the prize value falling between value 11 and, respectively, the upper prize value and the lower prize value.

Motherboard 9 includes a communications bus 25 for accommodating the communication between the various computing components shown.

It will be appreciated that the figures are highly schematic and intended to provide the skilled addressee with an understanding of the features and functionality provided by apparatus 1 and the interaction between the components illustrated. It would be understood from the teaching herein that those functionalities and interactions are able to be implemented in other ways. For example, for the purposes of clarity, the functionality of processor 15 is, in this embodiment, separated from that of processor 8. However, in practice, the functions of one or more of processors 8, 15 and 17 are able to be performed by a single processor.

Card 4 is a dedicated hardware device that is linked to bus 25 by an external communications bus 26. Both these buses are schematic representations of a plurality of digital lines. In some embodiments, bus 26 includes one or more analogue lines—for video and audio—in addition to the digital lines.

As shown in FIG. 1, terminals 6 are respective gaming machines that are co-located in a single gaming establishment 27. While only four terminals are shown, it is usual to have many more than this—from ten to many hundreds—linked by apparatus 1. Where it is desired to link greater numbers of terminals use is made of a structured network of apparatus 1. To this end, apparatus 1 includes a network card or communications card 28, as shown in FIG. 2. In some embodiments, card 28 is configured for wireless communication.

Terminals 6 are typically physically arranged in groups or lines and are presented to make them easily accessible for gamers and to contribute to the social event engaged in by the gamers. Each terminal includes a dedicated interface card (not shown) to provide and receive predetermined communications signals to a 10 Mbits/s Cat 5 communications bus 29. In other embodiments use is made of an existing network, such as CMS, to affect the required communications. In other embodiments use is made of an alternative network or networks.

Bus 29 is also linked to card 4 for allowing apparatus 1 to communicate with terminals 6. It will be appreciated that terminals 6 in this embodiment do not communicate with each other, but only with apparatus 1. However, the communication between each terminal and apparatus 1 is two-way. In other embodiments the communication between the terminals 6 and apparatus 1 is one-way. This is often due to legislative requirements in the jurisdiction in which the embodiment is implemented.

In practice, apparatus 1 is located away from terminals 6 and in a location that is easily accessible by technical staff of the establishment. For example, in some embodiments, apparatus 1 takes the form of a networked server and is located together with other servers and computer equipment in a dedicated room within the establishment. More preferably, the location makes the networked server secure against physical tampering, and use is made of appropriate software barriers and tools to prevent unauthorised electronic access to the server.

As best shown in FIG. 2, apparatus 1 includes a display driver in the form of a video card 31 for providing a video output signal that contains information indicative of the accumulating values. In some embodiments, the video output signal includes data indicative of one or more of the upper prize value and the lower prize value. For example, in instances where the accumulating values are being incremented by processor 8 toward the upper prize value, the video signal includes data indicative of the upper prize values such that the gamers using terminals 6 will have that information displayed to them. However, in other embodiments information indicative of the both the upper and lower prize values is included in the video signal and other cues are used to provide the gamer with an indication of which of those values is of greater relevance at any given time.

Card 31 is provided command signals and data signals by processor 8 via bus 25 and 26. These signals are processed by the circuitry and software available on the card to provide the output signal that is, in this embodiment, propagated via a video and audio cable 32. In some embodiments the command signals and data signals are combined.

Cable 32 provides a video feed for a dual screen video display 33 which includes audio reproduction devices in the form of an audio amplifier 34 and a plurality of spaced apart speakers 35. In this embodiment, display 33 includes two large LED displays 36 that are prominently located within establishment 27 near terminals 6 For larger establishments with a greater number of terminals, or where the terminals are for other reasons spatially dispersed, display 33 includes a plurality of spaced apart LED displays or other displays for best providing all the gamers of terminals 6 with the desired information about the progress of the central jackpot game in which they are participating. While the central jackpot game is referred to in the singular, it will be appreciated that this game includes, at least at some times, a plurality of prizes that are simultaneously on offer. In effect, the single jackpot game is providing the gamers with a plurality of additional games.

The location of the LED displays within establishment 27 is intended to allow the gamers utilising terminals 6 to easily determine the quantum of the accumulating value. In this embodiment, display 33 also provides the gamers with a visual indication of the upper prize value and the lower prize value, and whether the accumulating value is incrementing upwardly or downwardly. In those embodiments where more than one prize is available simultaneously to be awarded—for example, where different levels of prizes are used—display 33 is able to display all the relevant accumulating values, upper prize values and lower prize values.

In other embodiments, the LED displays 36 are substituted with one or more spaced apart plasma screens, video projectors, television monitors, CRT projectors or other display devices. The use of spaced apart display devices is particularly advantageous where there are many terminals 6 within the establishment, or where those terminals 6 are distributed widely within the establishment. For those embodiments where terminals 6 are not all in the same establishment, then provision is made for separate displays in the separate establishments.

The use of display 33 is advantageous as it provides information to the gamers and allows them to derive more entertainment and enjoyment for a given wager. It is also advantageous to have display 33 as a separate component that is prominently located, as that provides open information to potential gamers as to extra benefits of terminals 6 over prior art terminals.

In other embodiments, a separate display 33 is not used. That is, the visual indication is provided as a digital signal via bus 29 directly to terminals 6. In turn, this signal is received by the respective interface cards in the terminals and displayed on the screens of the terminals. This is particularly advantageous for those embodiments where not all terminals 6 are located at within the across at least two different establishments.

In further embodiments use is made of both a separate display 33 and a display on each of the individual terminals.

Figure 3:
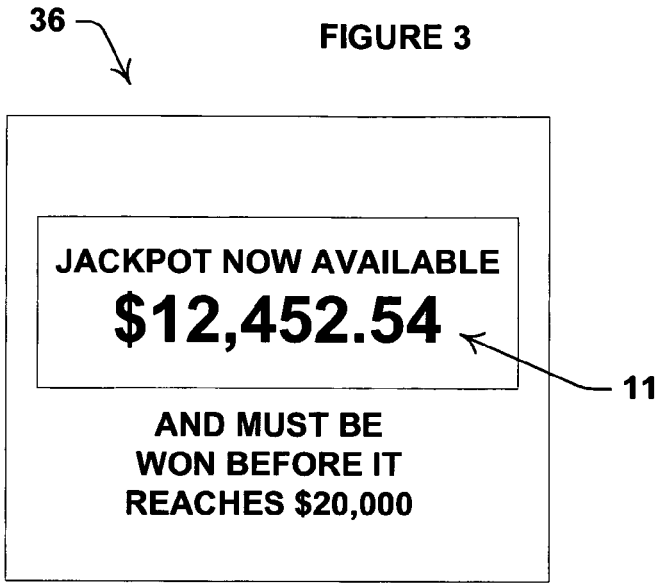
FIG. 3 is a schematic view of a display that is driven by the apparatus of FIG. 2.

Referring to FIG. 3 there is diagrammatically illustrated the information provided to gamers by one of displays 36. This includes accumulating value 11—shown in this instance as $12,452.54—and the upper prize value—shown in this instance as $20,000. In use, value 11 is usually incremented every polling period, which in this embodiment is every 1.5 seconds. In other embodiments the incrementing of accumulating value 11 occurs more or less frequently than every polling period. However, in the embodiments it is preferred that the displayed accumulating value 11 regularly increments to provide to the gamers with regular, if not seemingly constant, change of that value. In the embodiments described in this specification only the accumulating value 11 and one or more of the upper and lower values are displayed to gamers. In other embodiments additional information is displayed to the gamers including, for example, one or more monetary values corresponding to prize values that have been awarded recently, or which were not awarded.

Apparatus 1 includes a payout device in the form of a payout circuit 39 on board 9, which is responsive to the increment signal and the award signal for selecting the terminal to which the prize is awarded. It will be appreciated that each terminal 6 includes data indicative of a gaming balance that is available to the gamer using that terminal. Circuit 39, upon selecting the terminal, credits the respective gaming balance. In this embodiment circuit 39 credits the gaming balance by the accumulating value. In other embodiments the gaming balance is credited by a different amount. In those embodiments where each terminal 6 has an SEI card, as is the case with the present embodiment, it is possible to transfer and store the funds awarded to the SEI card of the respective terminal. This then facilitates a tertiary game for the gamer in that the awarded funds are able to be wagered as part of a tertiary game. That is, only those terminals 6 with stored values of awarded funds from the secondary game will be able to participate in the tertiary game, and only with those awarded funds or additional funds won in the tertiary game. One example of a tertiary game is a simple "double up" game that allows the gamer the choice of wagering the amount awarded from the secondary game, with a 50% chance of doubling the value of the awarded funds, and a 50% chance of loosing the awarded funds. Once the tertiary game is completed any remaining funds are transferred to the gaming terminal. In other embodiment, however, the gamer has to provide a positive affirmation that the funds are to be transferred. Furthermore, once the gamer has decided to cease the gaming session, any credit balance on terminal 6 is able to be redeemed in the usual manner. This includes, by way of example, a cash payout from the terminal, a ticket printed by the terminal, the update of the gamer's smartcard by the terminal, or the gamer seeking the payment from a cashier or other centralised payment point. If the credit balance is large, the most practical ways of affecting a redemption requested by the gamer is to:

1. Affect a manual payment.
2. Transfer the value to the player's terminal.
3. If available, print a ticket using a ticket printing device located at the terminal.
4. Credit the player's credit card or online wallet.
5. Transfer the balance to a mobile device with technology for allowing such a transfer—such as, but not limited to, a cellular telephone, a PDA, or a mobile computer—for redemption at a later time.

Related patent applications for this technology include PCT patent application nos. PCT/AU2005/000615 and PCT/AU2006/001530, the subject matter of which is incorporated herein by way of cross-reference.

Figure 4:
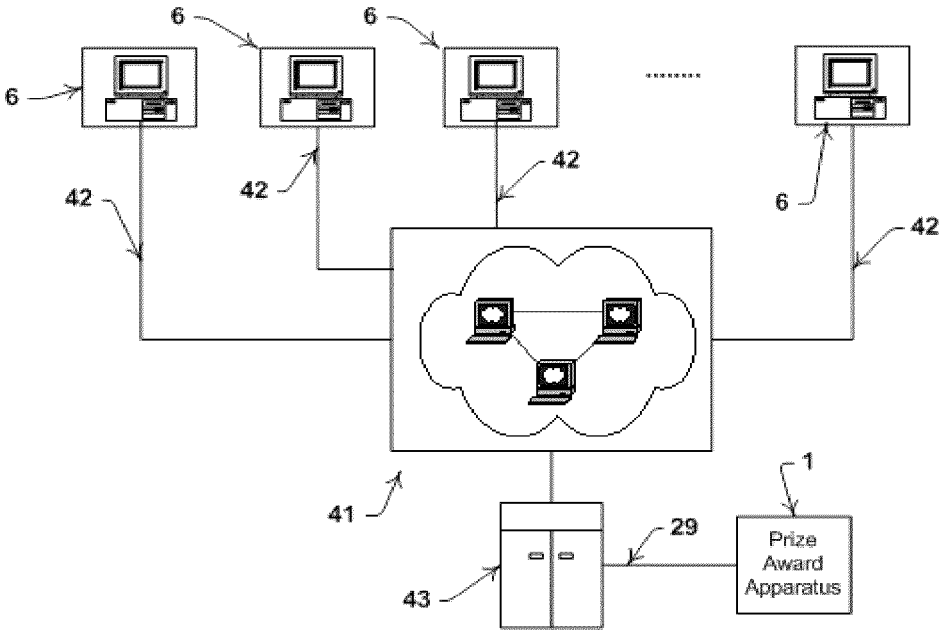
FIG. 4 is a schematic view of an online gaming network including an apparatus according to the invention.

In other embodiments, such as that shown in FIG. 4, terminals 6 are computer devices such as stand alone desktop computers that are remotely located. In this embodiment, each computer is at the residence of the respective gamers. The computers are each linked to the internet 41 via respective telephone lines 42. Apparatus 1, on the other hand, is linked to an internet server 43 via bus 29. In other embodiments the computers are linked to the internet other than by telephone lines. For example, in some embodiments, use is made of wireless links, cable connections or other available links.

Server 43 allows communication between terminals 6 and apparatus 1 to provide the same functionality as that achieved by the FIG. 1 embodiment. However, in this case, the delivery of the information is browser based.

In some embodiments, apparatus 1 communicates both with terminals that are gaming machines and terminals that are remotely located desktop computers.

It will be appreciated by those skilled in the art, from the teaching herein, that server 43 will also allow the invention to be performed with terminals that are laptop computers, mini-computers, PDA's and other computing devices with internet, 3G or WAP capability. Moreover, in some embodiments, server 43 is able to interact with gamers by way of the cellular telephone network.

Reference is specifically to FIG. 1 and FIG. 2. In use, the gamers operating terminals 6 are participating in a game of chance that is contingent upon the predetermined virtual spacing on a screen of the respective gaming terminals of a number of icons. Once the gamer establishes a credit balance with the terminal, by one of various means, it is possible for the gamer to initiate a gaming sequence. After the sequence has played out, and the result displayed on the screen of the terminal, the terminal then provides a respective input signal 5 on bus 29 via a further SEI card (not shown).

Signal 5, in this embodiment, includes a multi-bit string of information having a unique identifier for the terminal, the quantum of the wager placed upon the gaming sequence that was completed, and the percentage or part of that wager that is to be used by apparatus 1. This percentage or part of the wager is referred to as "the contribution" by the relevant terminal, and may be either expressed as a percentage or as an absolute monetary amount.

When respective gamers are simultaneously playing the terminals, a stream of input signals are provided by the respective SEI cards and received by card 4. This stream of signals is grouped in batches taken over a polling period. A typical polling period has a duration of less than one second and in some embodiments about 300 milliseconds. However, in other embodiments the polling period is greater than one second. In this specific embodiment each polling period has the same duration, that being 1.5 seconds. In some embodiments different polling periods have different durations. For example, in some embodiments the duration of the polling period is dependent upon the number of terminals 6 being operated. For those times during a day where there are many terminals operating and providing respective signal 5, the polling period is less. In further embodiments, the polling period is determined by signals 5, in that card 4 will always batch a predetermined number of signals 5. Particularly, in one embodiment card 4 is configured to include one hundred signals 5 within each batch. Accordingly, when there are only fifty terminals 6 being used by respective gamers, each terminal will on average provide two sequential signals 5 to card 4 prior to value 11 being incremented. And the time of the polling period—which is approximately the time between the oldest and youngest signal 5 included with a batch—will be dependent upon the activity of the terminals. In other embodiments, the batching of signals 5 is determined by the contribution from the terminals being at or above a predetermined threshold. For example, card 4 in some embodiments finalises a batch once the total contribution in the batch is above $5.00. In other embodiments, alternative thresholds are used.

In further embodiments, the batching of signals 5 is determined by one or a combination of the above factors.

In addition to the individual games of chance, the gamers are also participating in an additional group game of chance, in that they are eligible to win one or more of the "jackpot" amounts. The two games—that is, the primary games on respective terminals 6 and the secondary or jackpot game provided by apparatus 1—are independently operated in that the probability of a gamer winning one of the games does not affect their probability of winning the other except insofar as the amount contributed to winning the jackpot amount is contingent upon the quantum of the wager for the individual game of chance being played on the respective gaming terminals. In this embodiment, the secondary game includes a single prize the value of which is not displayed to the gamers and which is selectively changed, as described above, based upon the progress of the secondary game. Once the single prize has been awarded—due to the accumulating value having reached the prize value in a given polling period—a further prize is selected or determined to be available to be awarded in a subsequent polling period. The value of the further prize is also subject to selective change in accordance with the above description.

The description of the embodiments in this specification makes a distinction between a prize per se, and the value of the prize, in that the described embodiments change the value of the prize if the prize is not awarded for a given polling period. It will be appreciated by those skilled in the art that an equivalent to this is to determine whether a first prize is to be awarded for a first polling period and, if not, to select or determine a second prize that is available to be awarded for a second polling period subsequent to the first polling period. A skilled addressee will appreciate that the prize value is a "mystery jackpot amount", and that a change of the prize value—notwithstanding the prize is not to be awarded—equates to the change of the mystery jackpot amount.

Card 4 is responsive to signals 5 during a first period, where the first period is a first polling period. This polling period is an interval of time having a duration in which signals 5 are batched for subsequent processing. The polling period is selected for apparatus 1 on the basis of one or more of:

The gaming venue in which terminals 6 are located.

The number of terminals 6 in the gaming venue.

The likely minimum time between two consecutive wagers being made on any one of terminals 6. That is, there is usually a desire, for a given polling period, that each signal 5 is provided by a separate one of terminals 6.

The processing speed of any one or more of card 4, processor 8, processor 15 and processor 17.

In this embodiment where the gaming venue includes fifty terminals 6, the duration of the polling period is about 1.5 seconds. However, in other embodiments the duration of the polling period is different. For example, in larger embodiments the duration of the polling periods is often as low as about 400 msec, while in smaller venues with a lesser number of terminals the duration of the polling periods is greater than 1.5 seconds.

Device 2 includes data indicative of the prize values as well as, for each level, the upper prize value and the lower prize value. The upper prize value for a level is the maximum possible value of the prize to be awarded at that level, while the minimum prize value is the minimum possible value of the prize to be awarded for that level. Device 2 holds the data indicative of the prize values in a data structure such as a data table which includes a plurality of tables having column headers that are discussed further below. In other embodiments additional, substituted or alternative column headers are used.

It will be appreciated that device 2 stores data indicative of value 11 and other data.

In other embodiments, card 4 is a network card designed to retrieve the appropriate information from a plurality of gaming devices, whether those devices be stand alone gaming machines, personal computers running gaming software, lottery terminals, or the like.

In this specification use is made of the term Electronic Gaming Machine (EGM) to refer to a gaming machine, where these types of machines are also known as poker machines or slot machines. The FIG. 2 embodiment is specifically developed for use with a plurality of EGMs that are linked by a computer network having a communication protocol to allow the participation of the gamers of the EGMs in a linked jackpot game, which is otherwise referred to as a secondary game or a common game. This common game is provided by an operator of apparatus 1 in addition to the primary game that the gamers are playing on respective EGMs. Each terminal includes a further SEI card (not shown) for linking the terminal to the network and for allowing communication between the terminals and apparatus 1 via card 4.

In the FIG. 1 embodiment the EGMs are co-located within a common room or gaming establishment and are linked by a LAN maintained by an operator of the establishment. While in this specific embodiment the operator of the establishment is different to the operator of apparatus 1, in other embodiments there is a common operator. Moreover, in other embodiments, the EGMs are more geographically dispersed, and are linked by a WAN or other network that is maintained or owned by more than one operator and/or other parties.

It will also be appreciated that the network communications between nodes within any network—that is, any nodes within the WAN, LAN or other network—is preferably achieved primarily with physical cabling. In other embodiments, however, use is made of wireless communication paths either in combination with or as an alternative to the cabling.

Storage device 2 includes one or more of the following elements:

A hard disk drive.

RAM.

ROM.

A CD/DVD drive for selectively containing a CD/DVD.

The data required to operate apparatus 1 is selectively stored in one or more of the above elements. In addition, it will be appreciated that all of processors 8, 15 and 17 will include some onboard cache that is also able, if and when required, to contain some or all of the data.

As mentioned above, there may be a plurality of prizes to be awarded by apparatus 1, where each prize is awarded in sequence. In other embodiments, apparatus 1 makes use of levels, in that a plurality of prizes are available to be awarded simultaneously, but as part of a respective separate secondary games that are all run in parallel.

The terminology of "level" or "levels" arises from the often large differences between the prize values attributable to the prizes to be awarded in the different jackpot games that are progressing in parallel. It would not be unusual for the differences between prize values awarded in adjacent levels to be an order of magnitude. That is, for each level the ranges defined by the respective pairs of lower prize value and the upper prize value are very different, and usually these ranges do not overlap. In the above example only the fifth and sixth levels have ranges that overlap. However, in other embodiments there is an overlap between the ranges of other levels.

Use is made of a plurality of levels to:

Providing gamers with variety, in that there are many prize values likely to be awarded at any given time.

Provide a spread of prizes of significantly different value to accommodate gamers who are skeptical about ever winning a larger jackpot.

Provide operators with some certainty about the quantum of the prize values to be awarded to better allow control of player return rates and costs.

While some aspects of the data stored in device 2 is set out above, it will be appreciated that this is typically a subset of the total data stored. For example, in the embodiment being described device 2 stores a data table having the following columns:

| Column Header | General Description |
|---|---|
| Prize Number | A unique integer or string for each prize in the table. Preferably the integer or string is unique for all prizes to be awarded by the embodiment. |
| Level Number | A unique integer or string to identify the level that each prize value has been assigned. In some embodiments each level includes only a single prize, while in other embodiments a level includes more than one prize. In some embodiments use is not made of levels and the or all prizes have a default level number of 1. |
| Prize Value | A value for each prize, typically a financial value expressed in a currency used in the jurisdiction. In other embodiments, however, the value is expressed in non-financial units or symbols. A sub-set of these other embodiments later converts the units or symbols to a currency. In the embodiments this value is not determined until just prior to when the prize is first available to be awarded. And the prize value is subject to change after that until such time as the prize is awarded. |
| Write Time | The time the latest prize value was written to the table. Expressed as accurately as allowed by the timing software used. |
| Prize Award Flag | This flag applies to each prize, and is set to indicate that the respective prize has been awarded. That is, this field in this column of the data table is indicative of whether the current prize value has been defined by the respective prize values and awarded. |
| Award Time | The time the prize was awarded. Expressed as accurately as allowed by the timing software used. Prior to a prize being awarded, this field in the table - for that specific prize - has a null value. |
| Award EGM | Indicative of the EGM that is determined to have provided the input signal resulting in the award of the current prize. |
| Upper Prize Value | A financial value that indicates for a given level the maximum value of prize able to be awarded. This is typically set by the operator of the gaming venue or venues in which the EGMs are disposed and is usually displayed or otherwise made known to the gamers. |
| Lower Prize Value | A financial value that indicates for a given level the minimum value of prize able to be awarded. This is typically set by the operator of the gaming venue or venues in which the EGMs are disposed and is usually displayed or otherwise made known to the gamers. |
| Weighting | A number that is assigned to each level or each prize that is used in the calculation of the contribution to be made to the respective accumulating values during a given polling period. In some embodiments the weighting is a value assessed relative to other weightings, while in other embodiments the weighting is expressed in terms of a percentage of the turnover for the polling period. Each weighting is able to change with time. |
| Reset | The reset percentage is the percentage of turnover that is contributed to the start of the next jackpot for a given level. |

In other embodiments alternative or additional columns are included in the data table.

The operator of the gaming establishment (also known as a gaming venue) is able to set the upper and lower values in accordance with the desired size of maximum and minimum prize values to be awarded to gamers of EGMs provided in the establishment. This in turn is based upon a number of factors such as the average value of the wagers regularly made at the venue, the turnover at the venue, the time of day, the percentage of the wager made at the EGMs that is indicated by the input signal as being contributed to the accumulating value, and others.

In response to any change by the venue operator of the upper and lower values from the default values there is a scaling of all the prize values to substantively retain the desired distribution of prize values between the upper and lower values. It will be appreciated that some rounding of prize values does occur during this operation to account for the number of decimal places being used determining the awarded prize amount.

In other embodiments the prize values are all predetermined and any adjustment by the venue operator of the upper and lower values has no effect on the prize values.

Figure 6:
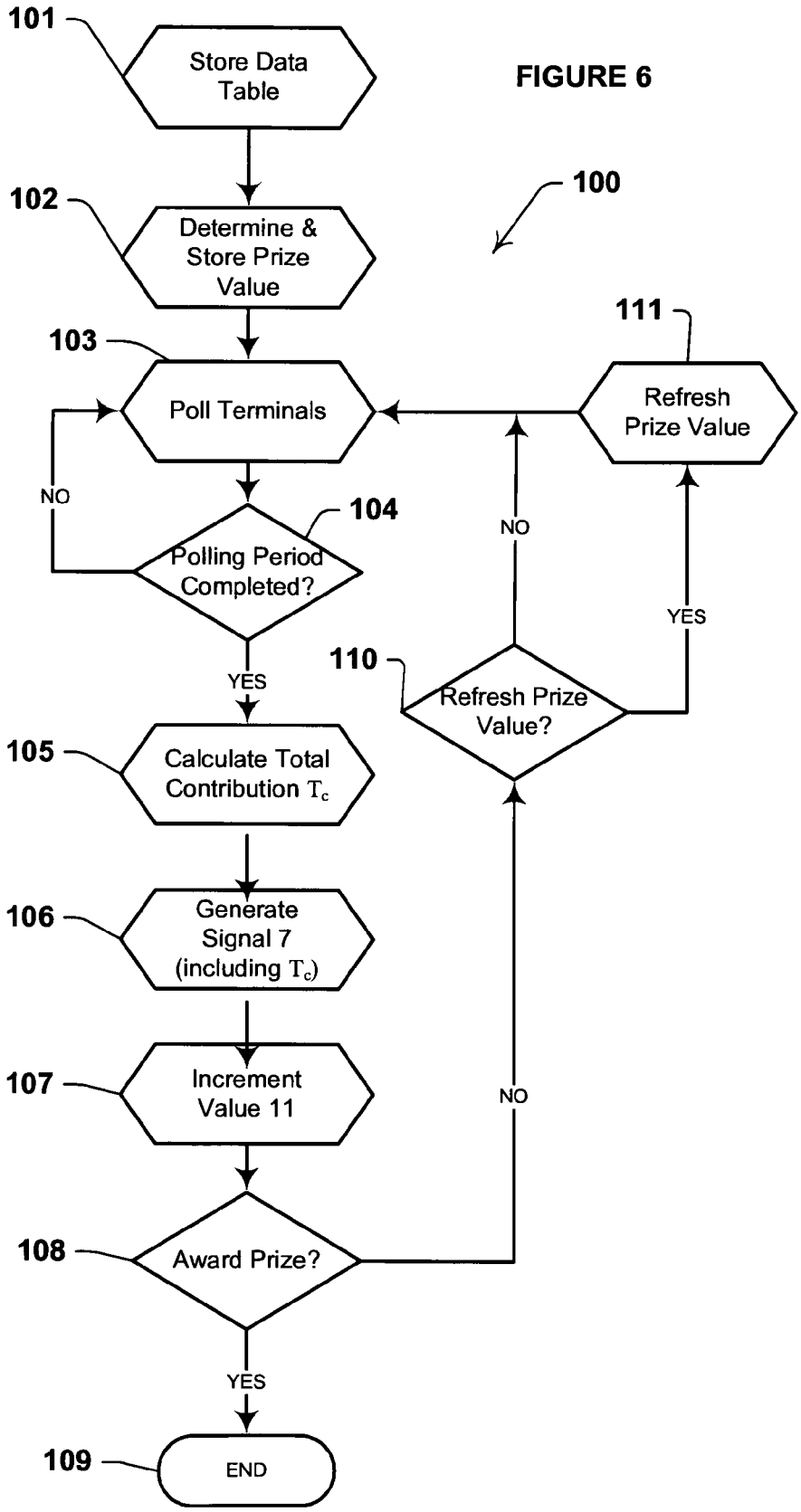
FIG. 6 is a flow chart illustrating the operation of the apparatus of FIG. 1.

Reference is now made to FIG. 6 where there is shown a flow chart of the methodology 100 followed by apparatus 1 in this embodiment. This methodology is illustrated by a sequence of steps that are described in more detail below. In other embodiments the methodology follows alternative steps.

Initially, apparatus 1 stores in device 2 (at step 101) a data table containing data fields such as those illustratively provided in the above. While there is a field for the prize value, this prize value is not set, in that it contains a null value. As will be described below, the prize value is changed every polling period that the corresponding prize is not awarded. In some embodiments the prize value is set either not used by apparatus 1, or used only as a basis for determining the prize value for the first polling period that the corresponding prize is available to be awarded.

At step 102, processor 17 is responsive to the data in the data table—and particularly to the records 18 and 19 that are indicative of the upper and lower values for the prize—for determining the prize value for the prize, and writing that prize value to record 3. It will be appreciated that the prize value is determined to fall between the upper and lower values 18 and 19. In this embodiment the determination of the prize value includes at least one random component, while in other embodiments the prize value is determined entirely randomly. It will be appreciated that the prize value is not displayed to the gamers, but rather the accumulating value is displayed. In this embodiment at the time a prize is to be awarded the accumulating value and the prize value will be substantially equal.

At step 103, processor 17 initiates card 4 to commence polling of terminals 6. In this embodiment the polling is undertaken on a time basis, in that each and every polling period has an equal duration of 1.5 seconds to provide an effectively real-time increment to value 11. It will be appreciated that the increments to value 11 will vary in quantum for different polling periods. The polling period is completed once card 4 determines at step 104 that 1.5 seconds has passed since the commencement of the polling period. In other embodiments alterative techniques are used to define the polling period. For example, in one such embodiment, the polling is performed by, at a first point in time, reading the current turnover meter for each EGM that is participating in the secondary game and comparing this reading to a second reading from the respective meters at a second point in time that is prior to the first. The difference in time between the first and the second reading and defines the polling period and the difference between the readings of the turnover meters defines the contribution to the secondary game by the respective EGMs. The differences are added together to provide a total contribution, which is multiplied by an increment percentage to define an increment that is included within the increment signal. Processor 8 is responsive to the increment included within the increment signal for incrementing value 11 by the increment.

At step 105, card 4 is responsive to signals 5 to extract the respective quantum of the wagers $\{q_1, q_2, \ldots, q_n\}$ and the respective percentage of those wagers $\{p_1, p_2, p_n\}$ that are to contribute to the secondary game being administered by apparatus 1. The multiple of these two elements for each signal 5 are summed to calculate a total contribution ($T_c$) for the polling period. That is:

$$T_c=(q_1\times p_i)+(q_2\times p_2)+\ldots+(q_n\times p_n)$$

In other embodiment alternative methodologies are used to calculate $T_c$. For example, in some embodiments where one or more of the gamers are identified when using terminals 6, use is made of a weighting for each terminal based upon a loyalty system for the gamers. Accordingly, while a default weighting is 1, a loyalty bonus for an identified gamer is able to be greater than 1 to increase the increment. The "cost" of this increment is then added to a loyalty bonus account to allow the operator to track the cost of providing the benefit.

Card 4 then, at step 106, generates signal 7, which includes data indicative of $T_c$. Processor 8, at step 107, is responsive to signal 7 for incrementing value 11 by $T_c$. In this instance, value 11 is incremented upwardly by $T_c$. At step 108, processor 15 is responsive to records 3 and value 11 for determining if the prize is to be awarded. This determination, in this embodiment, is dependent upon the accumulating value—which has for the relevant polling period being increased by $T_c$—exceeding the accumulating value 11. For prior to the polling period the accumulating value in respect of this prize was determined to be less than the prize value. If the accumulating value is for this polling period now greater than the prize value, and the prize is to be awarded, the prize is awarded by apparatus 1. This results in step 109 be reached, which is a termination point. In practice, step 109 includes a further process of determining whether there are additional prizes to be awarded and, if so, the process loops back to step 101.

If at step 108 it is determined that the prize is not to be awarded in respect of the polling period for which $T_c$ has been provided, processor 15 generates continue signal 16. Processor 17 is responsive to signal 16 at step 110 to determine whether to refresh the prize value. In this embodiment, processor 17 is responsive to each continue signal to refresh the prize value. In this embodiment the refreshing of the prize value includes changing the prize value to fall randomly within the range defined by the accumulating value for the latest polling period and either the upper prize value or the lower prize value, depending upon which the accumulating value is incrementing toward. That is, a new prize value is determined for each polling period. In other embodiments processor 17 is responsive to alternate continue signals to refresh the prize value. In still further embodiments, there is an additional determination of the number of polling periods for which a given prize value applies, and this is used by processor 17 at step 110. For example, in some embodiments, the determination of how many polling periods a given prize value is used is, itself, determined randomly or with a random component.

If the prize value is not to be refreshed processor 17 controls card 4 at step 103 to once again poll terminals 6, but for the next polling period. Alternatively, processor 17 at step 111 refreshes the prize value and then card 4 is controlled to undertake step 103.

The refreshing of records 3—that is, the refreshing of the prize value—includes assigning to that value a randomly determined value that falls between the accumulate value 11 and the upper prize value. In instances where the accumulating value is incrementing toward the lower prize value, the refreshing includes randomly determining the prize value to fall between the accumulating value and the lower prize value. It is possible that before and after being refreshed that value 11 is the same. However, in practice that is rare. In some embodiments use is made of pseudo-random component to ensure consecutive prize values for a given prize will not be equal. In other embodiments processor 17 also requires consecutive values either not to be equal, or to differ by a given amount or proportion. In some instances this requires a plurality of recalculations of the new prize value prior to refreshing records 3.

In other embodiments the refreshing of a prize value includes selecting the prize value from a list of available prize values that are contained within device 2. Preferably, the list includes many entries.

In other embodiments the prize value for a polling period is refreshed after step 104 for that period. That is, in these other embodiments steps 110 and 111 fall between steps 104 and 105. However, in some embodiments, steps 110 and 111 fall not immediately after 104, but before step 108.

It is possible to determine and/or refresh the prize value for a given polling period:

Prior to that polling period.

During that polling period, but prior to step 108 and more preferably prior to step 107.

After that polling period, but prior to step 108 and more preferably prior to step 107.

To provide real-time or as close as possible to real-time processing, it is preferred that the increment to value 11 at step 107 is competed for a given polling period prior to the end of the next polling period. More preferably, step 110 and, as required, step 111 are also completed prior to the end of the next polling period.

A specific sequential example of methodology 100 is provided below.

Lower prize value=$100.00.

Upper prize value=$200.00.

Prize value (determined at step 102)=$125.68.

Accumulating value =lower prize value=$100.00.

Polling period=1.5 seconds.

Contributions in first polling period=$20.00.

Contribution percentage is 1%. Accordingly, $T_c$=$0.20.

Accumulating value=$100.20.

The prize value ($125.68) is compared to the accumulating value for the first polling period ($100.20) and the accumulating value for the preceding polling period ($100.00). The differences between the prize value and the respective accumulating values has the same sign and, as such, it is determined at step 108 that a prize is not to be awarded.

At step 110 it is determined that there is a need to refresh the prize value for the next polling period, where the refreshed prize value=$100.38.

Contributions in next polling period=$20.00.

Contribution percentage is 1%. Accordingly, for the next polling period $T_c$=$0.20.

Accumulating value=$100.40.

The prize value ($100.38) is compared to the accumulating value for the first polling period ($100.20) and the accumulating value for the preceding polling period ($100.40). The differences between the prize value and the respective accumulating values in the two most recent consecutive polling periods have different signs and, as such, it is determined at step 108 that a prize is to be awarded. Apparatus 1 then determines which of terminals 6 is to be awarded the prize, and communicates with that terminal accordingly.

In the example provided above a sign change of the differences are compared between polling periods. If a difference is determined to be zero it is, in this embodiment, attributed a positive sign. However, in other embodiments it is attributed a negative sign.

It will be appreciated that the above embodiment refreshes the prize value after each polling period. Typically, the refreshing of the prize value will result in the prize value changing. However, there is a small but finite chance, due to the randomness of the selection of a subsequent value for the prize value, that the prize value will seemingly remain the same even though refreshed.

The refreshing of the prize value includes a selection of the prize value, and a writing of that selection to device 2.

The random selection of the prize value, both initially and when refreshed, is undertaken by randomly selecting a number between 0 and 1 and normalising that over the available range between the accumulated value and the relevant one or the upper prize value or lower prize value. In other embodiments the random selection is based upon a pseudo random selection, while in other embodiments use is made of random component and a predetermined component. An example of a predetermined component is the use of an offset that is added to the randomly generated number, where the sign of the offset changes between alternate refreshes of the prize value.

The major advantages of the embodiments include:

Use of a random component or components in determining prize values.

Any given prize value has only a short duration, regardless of whether it is awarded or not. Alternatively, a prize only has a short duration, regardless of whether or not it is awarded.

A prize does not necessarily have a fixed prize value until awarded. Rather, the prize value for a given prize is susceptible to change many times prior to the prize being awarded.

The prize will always be awarded while the accumulating value is within the range defined by the upper and lower prize values and, hence, the average payout to gamers will be retained at about the average of the upper and lower prize values. This provides greater certainty of cost and player payout percentages to operators.

Reducing the risk of unscrupulous individuals or groups of individuals from gaining advantage through access to the prize values.

Unless specifically stated otherwise, as apparent from the following discussions, it is appreciated that throughout the specification discussions utilizing terms such as "processing", "processing system", "computing", "calculating", "determining", "analysing" or the like, refer to the action and/or processes of a computer or computing system, or similar electronic computing device, that manipulate and/or transform data represented as physical, such as electronic, quantities into other data similarly represented as physical quantities.

In a similar manner, the term "processor" may refer to any device or portion of a device that processes electronic data, for example, from registers and/or memory to transform that electronic data into other electronic data that, for example, may be stored in registers and/or memory. A "computer" or a "computing machine" or a "computing platform" may include one or more processors.

The methodologies described herein are, in one embodiment, performable by one or more processors that accept computer-readable (also called machine-readable) code containing a set of instructions that when executed by one or more of the processors carry out at least one of the methods described herein. Any processor capable of executing a set of instructions (sequential or otherwise) that specify actions to be taken are included. Thus, one example is a typical processing system that includes one or more processors. Each processor may include one or more of a CPU, a graphics processing unit, and a programmable DSP unit. The processing system further may include a memory subsystem including main RAM and/or a static RAM, and/or ROM. A bus subsystem may be included for communicating between the components. The processing system further may be a distributed processing system with processors coupled by a network. If the processing system requires a display, such a display may be included, for example, a liquid crystal display (LCD) or a cathode ray tube (CRT) display. If manual data entry is required, the processing system also includes an input device such as one or more of an alphanumeric input unit such as a keyboard, a pointing control device such as a mouse, and so forth. The term "memory unit" or "memory" as used herein, if clear from the context and unless explicitly stated otherwise, also encompasses a storage system such as a disk drive unit. The processing system in some configurations may include a sound output device, and a network interface device, for example. The memory subsystem thus includes a computer-readable carrier medium that carries computer-readable code (for example, software) including a set of instructions to cause performing, when executed by one or more processors, one of more of the methods described herein. Note that when the method includes several elements, for example, several steps, no ordering of such elements is implied, unless specifically stated. The software may reside in the hard disk, or may also reside, completely or at least partially, within the RAM and/or within the processor during execution thereof by the computer system. Thus, the memory and the processor also constitute computer-readable carrier medium carrying computer-readable code.

Furthermore, a computer-readable carrier medium may form, or be includes in a computer program product.

In alternative embodiments, the one or more processors operate as a standalone device or may be connected, for example, by being networked to another processor or other processors. In such a networked deployment, the one or more processors may operate in the capacity of a server or a user machine in a server-user network environment, or as a peer machine in a peer-to-peer or distributed network environment. The one or more processors may form a personal computer (PC), a tablet PC, a set-top box (STB), a Personal Digital Assistant (PDA), a cellular telephone, a web appliance, a network router, switch or bridge, or any machine capable of executing a set of instructions (sequential or otherwise) that specify actions to be taken by that machine.

Where a figure only illustrates a single processor and/or a single memory that carries the computer-readable code, those in the art will understand that many of the components described above are included, but not explicitly shown or described to reduce the risk of obscuring the inventive aspect. For example, while only a single machine is illustrated, the term "machine" shall also be taken to include any collection of machines that individually or jointly execute a set (or multiple sets) of instructions to perform any one or more of the methodologies discussed herein.

Thus, one embodiment of each of the methods described herein is in the form of a computer-readable carrier medium carrying a set of instructions—for example, a computer program—that are for execution on one or more processors. For example, the one or more processors that are part of an apparatus for determining the award of a set of prizes. Thus, as will be appreciated by those skilled in the art, embodiments of the present invention may be embodied as a method, an apparatus such as a special purpose apparatus, an apparatus such as a data processing system, or a computer-readable carrier medium, for example, a computer program product. The computer-readable carrier medium carries computer readable code including a set of instructions that when executed on one or more processors cause a processor or processors to implement a method. Accordingly, aspects of the present invention may take the form of a method, an entirely hardware embodiment, an entirely software embodiment or an embodiment combining software and hardware aspects. Furthermore, the present invention may take the form of carrier medium (for example, a computer program product on a computer-readable storage medium) carrying computer-readable program code embodied in the medium.

The software may further be transmitted or received over a network via a network interface device (exemplified by interface card 4 and communications card 28). While the carrier medium is shown in an exemplary embodiment to be a single medium, the term "carrier medium" should be taken to include a single medium or multiple media (for example, a centralized or distributed database, and/or associated caches and servers) that store the one or more sets of instructions. The term "carrier medium" shall also be taken to include any medium that is capable of storing, encoding or carrying a set of instructions for execution by one or more of the processors and that cause the one or more processors to perform any one or more of the methodologies of the present invention. A carrier medium may take many forms, including but not limited to, non-volatile media, volatile media, and transmission media. Non-volatile media includes, for example, optical, magnetic disks, and magneto-optical disks. Volatile media includes dynamic memory, such as main memory. Transmission media includes coaxial cables, copper wire and fibre optics, including the wires that comprise a bus subsystem. Transmission media also may also take the form of acoustic or light waves, such as those generated during radio wave and infrared data communications. For example, the term "carrier medium" shall accordingly be taken to included, but not be limited to, solid-state memories, a computer product embodied in optical and magnetic media, a medium bearing a propagated signal detectable by at least one processor of one or more processors and representing a set of instructions that when executed implement a method, a carrier wave bearing a propagated signal detectable by at least one processor of the one or more processors and representing the set of instructions a propagated signal and representing the set of instructions, and a transmission medium in a network bearing a propagated signal detectable by at least one processor of the one or more processors and representing the set of instructions.

It will be understood that the steps of methods discussed are performed in one embodiment by an appropriate processor (or processors) of a processing—that is, a computer—system executing instructions—that is, computer-readable code—stored in storage. It will also be understood that the invention is not limited to any particular implementation or programming technique and that the invention may be implemented using any appropriate techniques for implementing the functionality described herein. The invention is not limited to any particular programming language or operating system.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination as would be understood by a skilled addressee given the benefit of the teaching herein.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus or system embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to a specific examples it will be appreciated that by those skilled in the art that it may be embodied in many other forms.

The claims defining the invention are as follows:

1. Apparatus for determining the award of a prize, the apparatus including:

memory for storing prize data indicative of a prize value for the prize;

an input device being responsive to input signals from a respective plurality of gaming terminals for providing an increment signal;

an increment device that is responsive to the increment signal for incrementing an accumulating value towards the prize value;

a comparator configured to periodically compare the accumulating value with the prize value, and, for each such comparison:

in the case that the accumulating value has incremented to or beyond the prize value, determining that the prize is to be awarded; and in the case that the accumulating value has not incremented to or beyond the prize value, providing an instruction to define a new prize value; and a processor that is responsive to the instruction for defining the new prize value, such that the increment device is then responsive to the increment signal for incrementing the accumulating value towards the new prize value.

2. Apparatus according to claim 1 wherein defining the new prize value includes changing the prize value.

3. Apparatus according to claim 2 wherein the memory stores range data that is indicative of an upper prize value and a lower prize value that collectively define a range that contains the prize value.

4. Apparatus according to claim 3 wherein the changing of the prize value results in the prize value falling between the accumulating value and one of the upper and lower prize values.

5. Apparatus according to claim 4 wherein the increment device increments the accumulating value toward the upper prize value and the changing of the prize value results in the prize value falling between the accumulating value and the upper prize value.

6. Apparatus according to claim 4 wherein the increment device increments the accumulating value toward the lower prize value and the changing of the prize value results in the prize value falling between the accumulating value and the lower prize value.

7. Apparatus according to claim 1 wherein the input device is responsive to the input signals during a first period and the comparator, in response to the accumulating value not incrementing to or beyond the prize value during the first period, generating the instruction to define a new prize value.

8. Apparatus according to claim 7 wherein the input device is responsive to the input signals during a second period subsequent to the first period and the processor is responsive to the instruction to define a new prize value for defining the prize value for the second period.

9. Apparatus according to claim 8 wherein the second period is immediately subsequent to the first period.

10. Apparatus according to claim 8 wherein at least one of the first and second periods are a polling period.

11. Apparatus according to claim 8 wherein the first and second periods are respective polling periods.

12. Apparatus according to claim 11 wherein the first and second periods are separated by at least one intervening polling period.

13. Apparatus according to claim 11 wherein the first and second periods are separated by a randomly determined number of intervening polling periods.

* * * * *